US006729703B2

(12) United States Patent
Le

(10) Patent No.: US 6,729,703 B2
(45) Date of Patent: May 4, 2004

(54) SNAP-IN LATCH

(75) Inventor: Baoloc Le, La Puente, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 10/085,761

(22) Filed: Feb. 28, 2002

(65) Prior Publication Data

US 2002/0117948 A1 Aug. 29, 2002

Related U.S. Application Data

(60) Provisional application No. 60/272,636, filed on Feb. 28, 2001.

(51) Int. Cl.[7] ..... A47B 88/00
(52) U.S. Cl. ..... 312/333; 312/334.46
(58) Field of Search ..... 312/333, 334.44, 312/334.46, 334.47, 334.45; 384/21

(56) References Cited

U.S. PATENT DOCUMENTS

| | | | | |
|---|---|---|---|---|
| 4,737,039 A | | 4/1988 | Sekerich | |
| 4,993,847 A | * | 2/1991 | Hobbs | 312/334.46 |
| 5,002,402 A | | 3/1991 | Parvin | |
| 5,169,238 A | | 12/1992 | Schenk | |
| 5,255,983 A | * | 10/1993 | Parvin | 312/333 |
| 5,411,333 A | | 5/1995 | Hoffman | |
| 5,507,571 A | * | 4/1996 | Hoffman | 312/334.16 |
| 5,551,775 A | | 9/1996 | Parvin | |
| 5,722,750 A | * | 3/1998 | Chu | 312/334.11 |
| 5,730,514 A | * | 3/1998 | Hashemi | 312/333 |
| 6,033,047 A | | 3/2000 | Hoffman | |
| 6,126,255 A | * | 10/2000 | Yang | 312/334.46 |
| 6,224,178 B1 | | 5/2001 | Cirocco | |
| 6,254,210 B1 | | 7/2001 | Parvin | |

FOREIGN PATENT DOCUMENTS

| | | | | |
|---|---|---|---|---|
| GB | 1589512 | * | 5/1981 | 312/334.47 |

* cited by examiner

*Primary Examiner*—Janet M. Wilkens
(74) *Attorney, Agent, or Firm*—Christie, Parker & Hale, LLP

(57) ABSTRACT

Removable hardware for a slide assembly. In some embodiments the hardware is laterally biasable with respect to a web of a slide member. In some embodiments the hardware is placed between a bayonet extending from the web and the web, with a tab protruding from the web into a window of the latch, with the window being dimensioned so as to maintain the tab in the window as the latch arm is flexed. In further embodiments the latch arm includes tines which grip protrusions extending from the web of the slide member.

33 Claims, 11 Drawing Sheets

SNAP-IN LATCH

CROSS-REFERENCE TO RELATED APPLICATION(S)

This application claims the benefit of the filing date of U.S. Provisional Application entitled Snap-In Aardvark Latch, Application No. 60/272,636, filed on Feb. 28, 2001 the disclosure of which is hereby incorporated by reference as if set forth in full herein.

BACKGROUND OF THE INVENTION

This invention relates generally to drawer slides, and more specifically to latch mechanisms for drawer slides.

Drawer slides for filing drawers, shelves, and the like are often desirable for use in, for example, desks, cabinets, and rack-mounted applications. Such slides slidably mount objects to a stationary structure while allowing the objects to be linearly extended from the stationary structure.

A typical slide assembly includes two or three slide members slidably, or rotatably, coupled by, for example, sets of bearings. The slide members extend linearly from one another. The bearings separate the slide members, with the bearings riding in raceways formed in the slide members. For telescope slide members, for example, each slide member generally has two raceways running along the length of the slide member, with the raceways separated by a planar web of the slide member.

In operation, the web of one slide member, for example the outer slide member of a telescopic slide, is fastened to the stationary structure. The inner member is attached to the moveable object. In some circumstances, such as during the mounting of the slide assembly, it is desirable to separate the slide members of the slide assembly. Many slide assemblies therefore contain a latch mechanism that normally prevents disengagement of the slide members, but may be disengaged so that the slide members can be separated.

The latch mechanism is often permanently mounted to the slide assembly. Manufacturers of equipment containing drawer slides may want to remove the latch mechanism, for example to alter the finish of the slide assembly. Installer or users may also desire due to damage to replace parts of the latches, or other hardware, affixed to a slide member.

BRIEF SUMMARY OF THE INVENTION

The present invention provides for removable hardware for a slide assembly. In one aspect of the present invention, the present invention provides a disconnect latch for a slide assembly comprising at least two slide members, the disconnect latch comprising a latch arm laterally biasable to a web of a first slide member; means for removably fastening the latch arm to the web of the first slide member of the slide assembly, the means for removably fastening being such that the latch arm is removable from the slide assembly; and means on a second slide member for contacting the latch arm during movement of the first slide member relative to a second slide member when the latch arm is in a first unbiased position, and for not contacting the latch arm during movement of the first slide member relative to the second slide member when the latch arm is laterally biased with respect to the web of the first slide member.

In another aspect of the present invention, the present invention provides a slide member with a disconnect latch for a slide assembly. The disconnect latch comprises a latch arm; a bayonet extending from a web of the slide member; a cutout in the latch arm, the cutout adapted to receive a portion of the bayonet when the latch arm is placed between the portion of the bayonet and a plane formed by the web of the slide member; the tab extending from the web of the slide member; and a slot in the latch arm adapted to receive the tab.

In a further aspect of the present invention, the present invention provides a slide member with disconnect latch hardware. The slide member with disconnect latch hardware comprises a slide member having a web and a bayonet extending from the web; and a latch arm between a portion of the bayonet and the web, the latch arm having a post, the post being located in an aperture in a portion of the bayonet.

In a further aspect of the present invention, the present invention provides a slide member with disconnect latch hardware. The slide member with disconnect latch hardware comprises a slide member having a web and a bayonet extending from the web; and a latch arm between an extension of the bayonet and the web, the latch arm including two hooked flexible members extending from a side of the latch arm, the area between the flexible members forming a holding area with the bayonet located within the holding area.

In a further aspect of the present invention, the present invention provides a slide assembly including a disconnect latch. The slide assembly including a disconnect latch comprises a first slide member; a second slide member slidably coupled to the first slide member, the second slide member having a bayonet extending from a web of the second slide member; and a latch arm removably fastened to the bayonet of the second slide member, the latch arm having a lever end extending from a base portion about the bayonet, the lever end being biasable parallel to a plane formed by a web of the second slide member; and a stop on the first slide member, the stop being in the travel path of the latch arm when the latch arm is in an unbiased position.

In a further aspect of the present invention, the present invention provides a slide member with removable hardware. The slide member with removable hardware comprises a slide member having a planer web and two brackets extending from the planer web, the brackets having a first portion extending away from the planer web and the second portion extending from the first portion substantially parallel to a plane formed by the planer web, the second portion of each bracket extending in opposing direction, the first portions being separated by a space; and plastic hardware including a body portion having a pair of tines, the tines each having a notch on the outer portions of the tines adapted to receive the first portions of the brackets, the tines being flexible so as to allow positioning of the tines in the space between the first portions of the brackets when the tines are flexed towards one another, with the tines each pressing against one of the brackets when the tines are unflexed.

In a further aspect of the present invention, the present invention provides a slide member with removable hardware. The slide member with removable hardware comprises a slide member having a planer web and the pin extending from the planer web; a pin extending from the planer web; and plastic hardware including a body portion having a pair of laterally flexible tines, the tines each having an opposing notch opposite one another on interior portions of the tines, the notches gripping the pin when the tines are unflexed, the tine being outwardly laterally flexible to allow the pin to be placed between the tines.

These and other aspects of the present invention will be more readily understood upon review of the disclosure including the accompanying figures.

DETAILED DESCRIPTION

Figure 1:
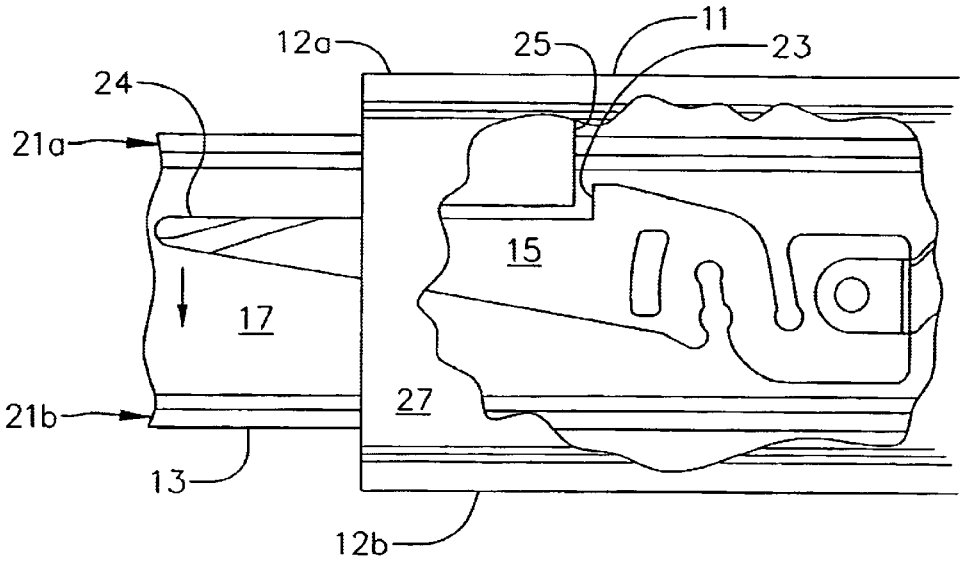
FIG. 1 illustrates a slide assembly containing an embodiment of a latch mechanism in accordance with the present invention.

FIG. 1 illustrates a slide assembly in accordance with aspects of the present invention. As illustrated, the slide assembly is a two member drawer slide, with the drawer slide extended to nearly full extension. The assembly includes an outer member 11. The outer member includes an elongated outer member web 27. Outer member flanges 12*a,b* are separated by, and run lengthwise along, the outer member web.

An inner member 13 is slidably coupled to the outer member. In the embodiment illustrated, the inner member 13 is nested between the outer member flanges, with the drawer slide being a telescopic drawer slide. The inner member includes an inner member web 17 and inner member flanges 21*a,b* that run along the length of the inner member web. The inner member is slidably coupled to the outer member by, for example, ball bearings (not shown) which ride in bearing raceways formed by the inner member flanges and outer member flanges.

A latch arm 15 is fastened to the inner member web. The latch arm includes a base and a finger 24 from the base. The latch arm is fastened to the inner member about the base, with the finger extending lengthwise along the inner member web. The latch arm includes an edge forming a latch arm stop surface 23. The latch arm stop surface is formed by a jog along the length of the latch arm, approximate the beginning of the extension of the finger from the base. As the latch arm runs along the length of the inner member, the latch arm stop surface is substantially transverse to the direction of motion of the inner member.

The outer slide member carries a slide stop 25. The slide stop is, for example, a tab punched out of a slide member web. Alternatively, the slide stop is an abutment on a guide block. As illustrated, the slide stop is approximate a forward end of the outer member, and extends into the travel path of the latch arm stop surface. Thus, as the inner member is displaced linearly from the outer member the latch arm stop surface contacts the slide stop. As the inner member is attached to the latch arm, the contact of the latch arm and the slide stop prevents the inner member from being further extended. Thus, unintentional disengagement of the inner member from the slide assembly is prevented.

At maximum slide extension, a portion of the finger of the latch arm, which forms a handle or lever, extends beyond the end of the outer member. Application of pressure on the latch arm lever flexes the latch arm in effect rotating the forward end of the latch arm about a pivot point area about the fastening area to the slide member. The flexing of the arm allows the stop surface to clear the slide stop. The inner member may then be removed from the slide assembly.

Figure 2:
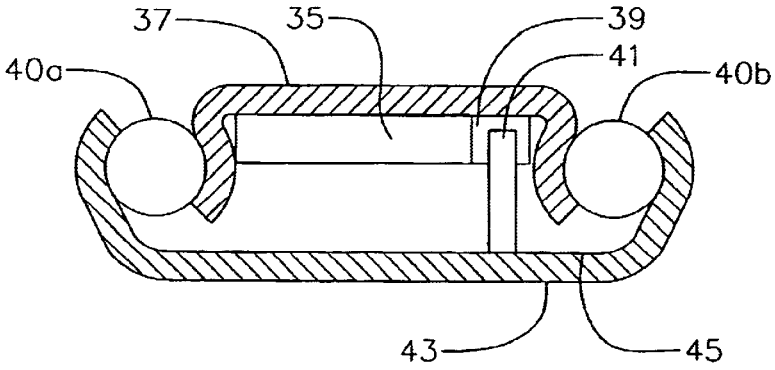
FIG. 2 illustrates an alternate view of the slide assembly of FIG. 1.

FIG. 2 illustrates a cross-sectional view of the slide assembly of FIG. 1. As illustrated in FIG. 2, a latch arm 35 is fastened to an inner member 37. The inner member is coupled by bearings 40*a,b* to an outer member 45. A slide stop 41, formed for example by bending a tab from the outer member, extends into the pathway of the latch arm when the latch arm is in a normal position. In the embodiment of FIG. 2, the slide stop projects from an outer member web 43. The slide stop surface occupied a path of travel of the latch arm stop. When the latch arm stop contacts the slide stop, the inner member is at full extension. To remove the inner member, pressure is applied to a latch arm lever (not shown) so that the latch arm stop surface no longer contacts the slide stop. The latch arm stop can then pass by the slide stop. Accordingly, the inner member may be removed.

Figure 3:
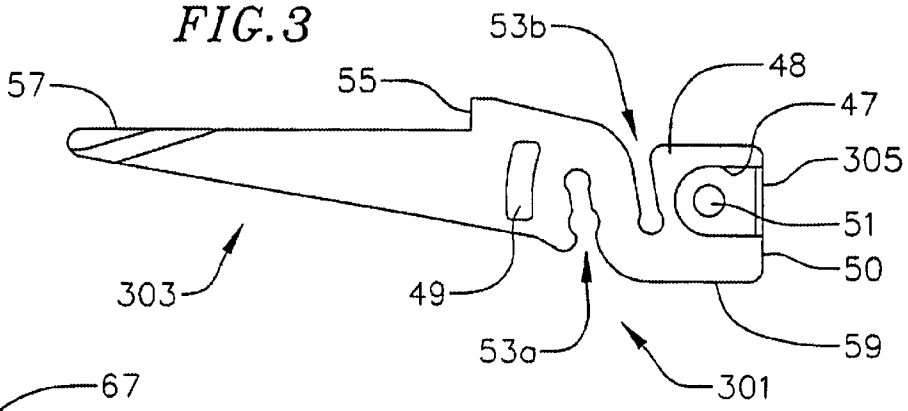
FIG. 3 illustrates an embodiment of a latch arm in accordance with the present invention.

FIG. 3 illustrates an embodiment of a latch arm, such as that of FIG. 1. The latch arm includes a base 301 and a finger 303 extending from the base. The base is slightly wider than the finger, which also narrows along its length, with a shoulder formed at the junction of the finger and the base. The shoulder forms a stop surface 55 adopted to contact a stop on a slide member.

Figure 4:
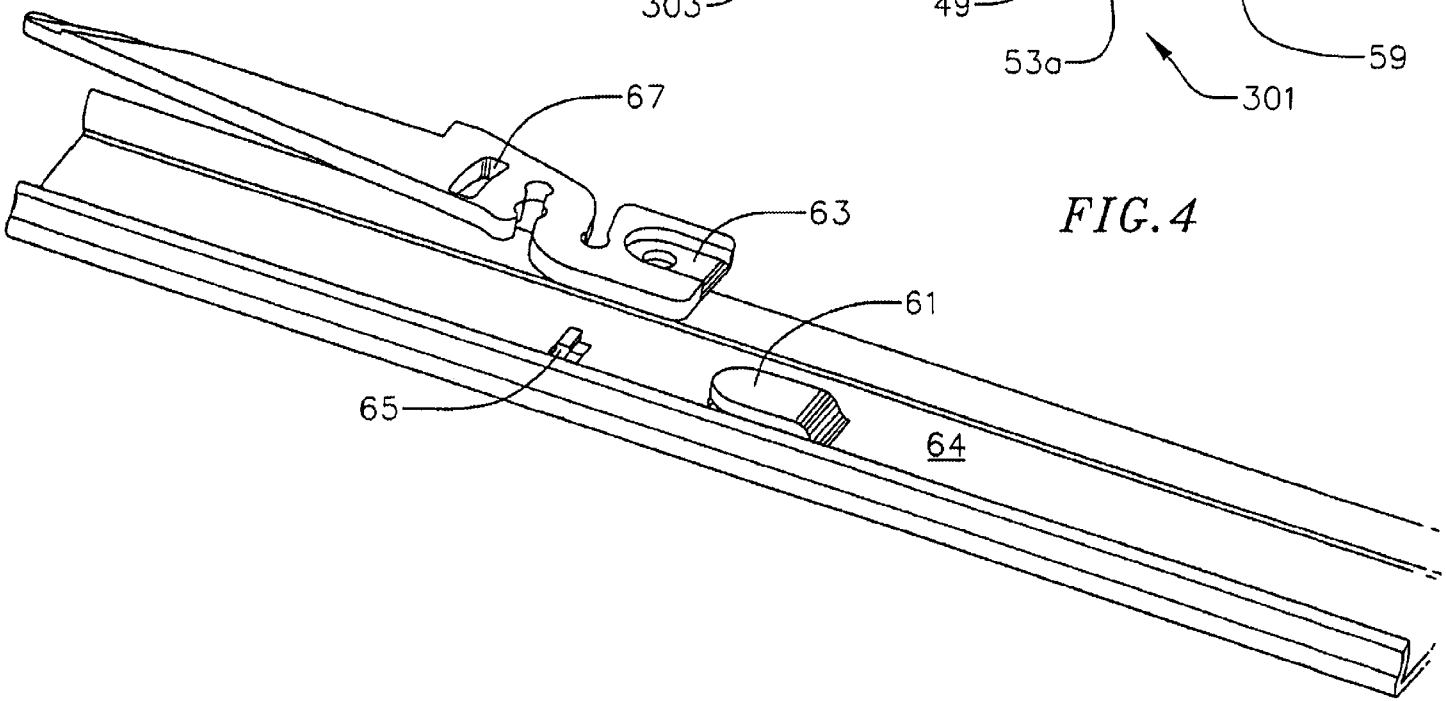
FIG. 4 illustrates the latch arm of FIG. 3 along with a slide member designed to hold the latch arm.

The base is adapted to be fastened to a slide member. The base includes a recess 47. The recess is a countersunk area on the base. The recess is positioned approximate an edge 50 of the body of the latch arm. A portion of the recess is open to an edge of the latch arm. That is, part of the recess extends to an edge of the body of the latch arm. As illustrated in the embodiment of FIG. 3, the recess extends to the rear edge 305 of the base, with the rear edge being opposite of the edge from which the finger extends. The recess is adapted to receive a bayonet of a bayonet tab from a slide member (such as illustrated in FIG. 4, for example), which allows the latch arm to be held against the web of the slide member and restrain the latch arm from movement in other than the formed direction. Moreover, as the recess extends to the rear edge of the latch body, rearward movement of the latch as a whole is stably prevented. That is, the bayonet tab prevent rearward motion of the latch by contacting the latch throughout the entire width of the latch, minimizing the possibility of the metal tab shearing off a portion of the latch.

In the embodiment of FIG. 3, the body of the latch arm includes a pair of opposing notches 53*a,b*. The notches are positioned such that each notch is open to a different edge of the latch arm, with the edges being along the length of the latch arm and the notches forming lateral notches. The lateral notches allow for increased movement of the latch when a lateral force is applied to the finger. When lateral, downward in FIG. 3 and generally parallel to a plane formed by the web of a slide member, force is applied to a latch arm lever 57 notch 53*b* expands. The opposing notches thus provide increased flexibility for the latch arm.

The body of the latch arm also includes a window or slot 49. The slot extends substantially transverse to the length of the latch arm. The slot, as illustrated, is in the body of the latch arm, but closer to the finger than the notches. The slot is adapted to receive a tab lanced from a slide member, with the tab restraining movement of the latch arm in two opposing directions, the directions being in the line of travel of the slide member. As the tab, in one embodiment, extends from the slide member a distance sufficient substantially equal to, or greater, than the width of the latch arm, the possibility of the tab shearing off a portion of a plastic latch arm is reduced. Thus, in the embodiment of FIG. 3 the slot, or elongated aperture, passes completely through the latch arm. In other embodiments, the aperture may be replaced with a recess that does not completely penetrate the latch arm. The recess and elongated aperture are adapted to couple to protrusions from a slide member. The elongated aperture and recess thus mount the latch arm to the slide member. Moreover, the length of the slot allows the tab to function as intended when the latch arm is laterally biased with respect to the web of the slide member to which the latch is fastened.

In addition, a rivet hole 51, passing through the latch arm, is located within the recess. Thus, the latch arm may also, or instead, be coupled to a slide member using a permanent fastener, such as a rivet, if desired. In one embodiment, the latch arm is mounted to a slide member by a fastener that passes through the rivet hole.

In one embodiment, a side surface 59 of the body is substantially flat. When the latch arm is mounted, the surface is near, or in contact with, an inner member flange (not shown). As the latch arm lever is depressed, the surface and the inner member flange contact. This contact provides resistance to torsional forces encountered by the latch arm, particularly about the bayonet.

FIG. 4 illustrates the latch arm of FIG. 3 along with an inner member designed to hold the latch arm in place. A bayonet 61 is formed integrally with the inner member, and extends from a web 64 of the inner member. The bayonet extends from a plane formed by the inner member web a distance sufficient to allow insertion of the latch arm between the web and the bayonet. More specifically, the bayonet extends a sufficient distance to allow for placement of the bayonet in the recess 63 of the latch arm. As illustrated, the recess and bayonet are of substantially the same dimension, such that the bayonet fits securely in the recess.

The inner member further includes a tab 65 lanced out from the web of the slide member. The tab is located such that it is contained within a slot 67 of the latch arm when the latch arm is mated to the slide member using the bayonet. The tab helps to prevent the latch arm from inadvertently sliding such that the bayonet is removed from the recess.

Figure 5:
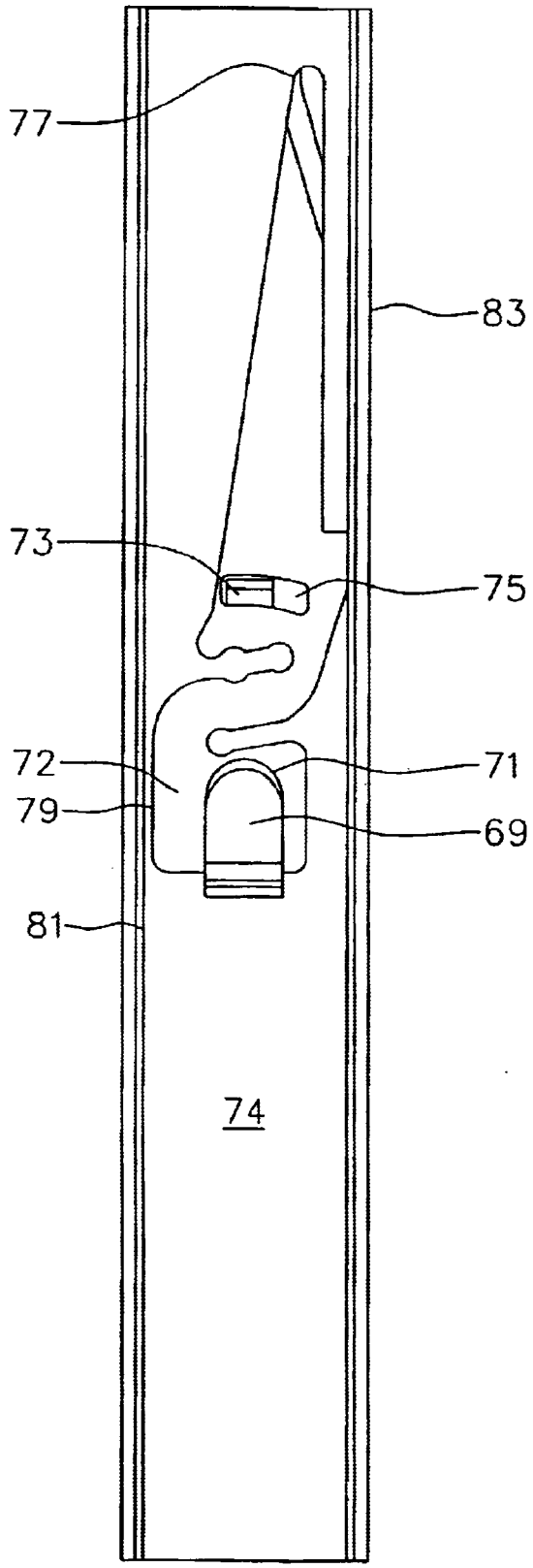
FIG. 5 shows the latch arm and slide member of FIG. 4 with the latch arm mounted on the slide member.

FIG. 5 illustrates the latch arm and inner member of FIG. 4, with the latch arm mated to the inner member. In FIG. 5 a bayonet 69 of the inner member is located within a recess 71 of the latch arm. The recess is located within a body 72 of the latch arm. A tab 73 is lanced out from a web 74 of the inner member. The tab is placed within a slot 75 of the latch arm. As illustrated, the tab occupies only a small portion of the slot in the elongated dimension. Thus, when downward pressure is applied to a latch arm lever 77, the latch arm may flex without the tab interfering with the movement of the latch arm however, should the latch arm start to slide away from the bayonet, the tab engages a wall of the elongated aperture, holding the latch arm in place.

In a normal position, the latch arm lever is positioned toward an inner member flange 83. In one embodiment, and as illustrated in FIG. 5 a surface 79 of the latch arm is positioned to be in contact with an opposing inner member flange 81 when downward pressure is applied to the latch arm lever. The surface and flange serve to resist torsional forces that result when pressure is applied to the latch arm lever. This reduces the torsional load that must be borne by the bayonet and recess, thus increasing the operating life of the latch assembly.

Figure 6A:
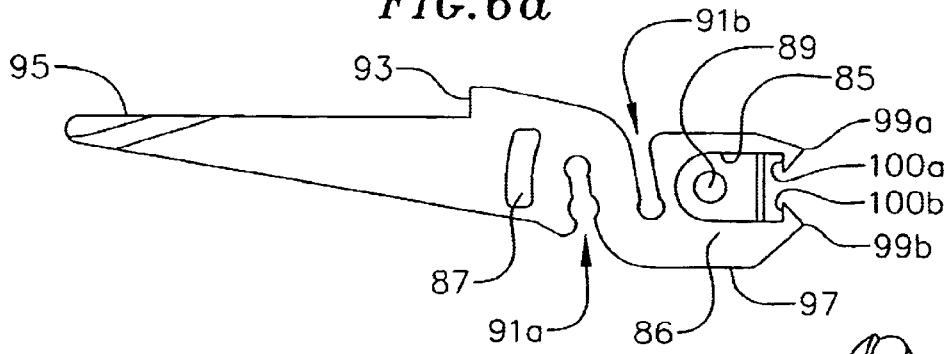
FIG. 6*a* is a diagram of another embodiment of a latch arm in accordance with the present invention.

FIG. 6*a* illustrates an alternate embodiment of a latch arm. The latch arm of FIG. 6*a* includes a recess 85. The recess is located in a body 86 of the latch arm. The recess is located approximate an edge of the body and continues to the edge of the body. The recess is adapted to hold a bayonet of a slide assembly. An elongated aperture 87 in the latch arm is oriented in a substantially vertical direction. A rivet hole 89, located within the recess, passes through the latch arm. The rivet hole optionally allows a fastener such as a rivet, bolt, or post to attach the latch arm to a slide member.

Two substantially vertical notches 91*a,b* are situated in a section of the latch arm between the recess and the elongated aperture. The notches serve to increase the flexibility of the latch arm. A first vertical notch 91*a* is open to a first side of the latch arm. A second vertical notch 91*b* is open to a side of the latch arm opposite the side that the first vertical notch is open to. Thus, the section of the latch arm about the vertical notches is somewhat s-shaped. A latch arm stop 93 extends above a latch arm lever 95. The latch arm lever extends outward from the body on a side of the elongated aperture opposite the notches and below the latch arm stop. The latch arm lever gradually tapers to an end. A substantially flat surface 97 of the body is positioned near the recess. As discussed above, the surface reduces the torsional forces experienced by the recess and bayonet.

The embodiment of FIG. 6*a* also includes two hooks 99*a,b* protruding from a side of the body. As illustrated, one hook extends from the latch arm on each side of the recess. Inside surfaces 100*a,b* of the hooks face the recess. The hooks grip a bayonet when the latch arm is mounted on a slide member. For example, during installation, the latch arm is pressed into the bayonet, with the bayonet biasing the hooks apart. As the hooks pass a rearward end of the bayonet the hooks return to their normal position, and enclose the bayonet in the recess. The hooks prevent the latch arm from inadvertently sliding off of the bayonet. Thus, in this embodiment a tab positioned in the elongated aperture is not used to prevent the bayonet from sliding out of the recess. However, such a tab may be used in other embodiments, including embodiments using the hooks of the embodiment of FIG. 6*a*.

Figure 6B:
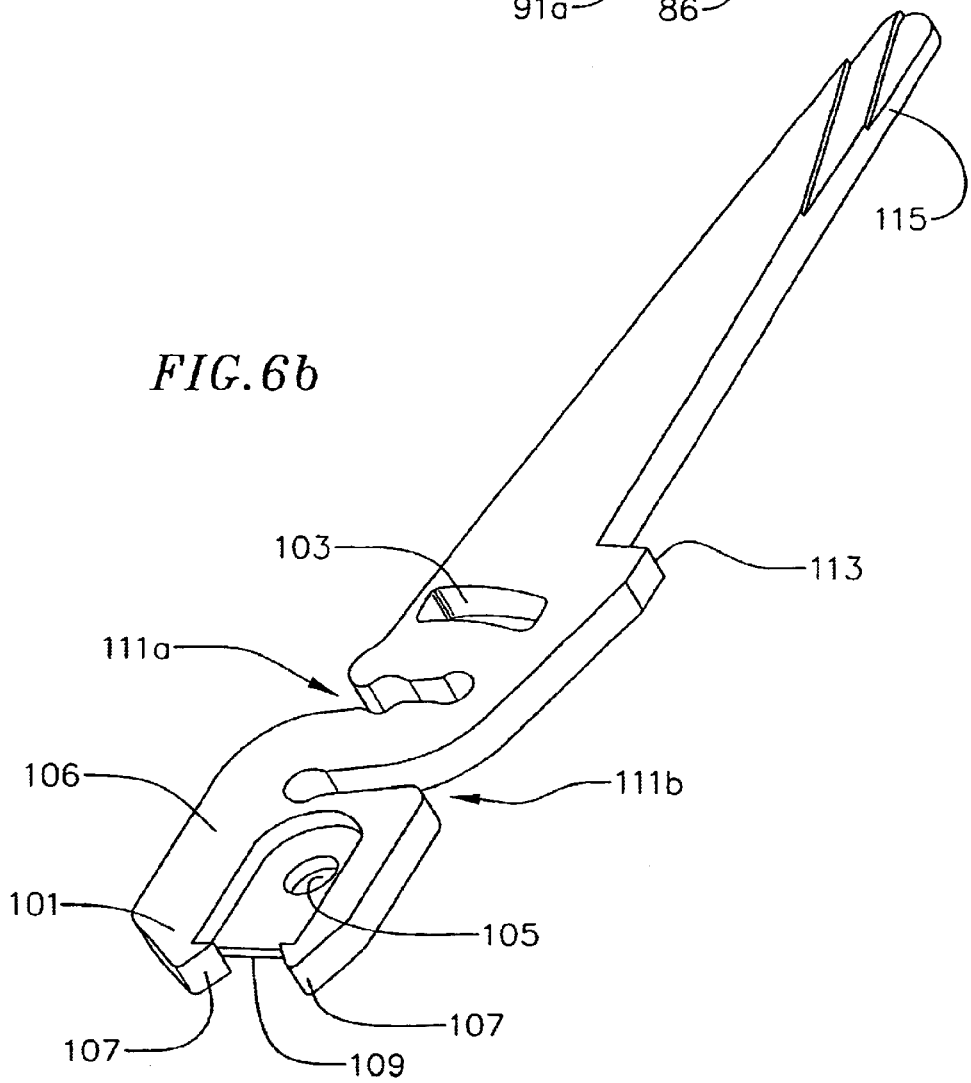
FIG. 6*b* illustrates an perspective view of the latch arm of FIG. 6*a*.

FIG. 6*b* is a perspective view of the latch arm of FIG. 6*a*. The latch arm includes a recess 101, an elongated aperture 103, a rivet hole 105, and a body 106, arranged as discussed above with reference to FIG. 6*a*. As illustrated, hooks 107 extend from the recess. The distance between the hooks is approximately equal to the width of the recess. As above, substantially vertical notches 111*a,b* provide increased flexing of the latch arm. This allows for easier disengagement of a latch arm stop 113 when pressure is applied to latch arm lever 115. When mounted, a bayonet (not shown) passes through a space 109 located between the hooks and the edge of the recess. Thus, the bayonet is contained within the space formed by the recess and the hooks.

Figure 7:
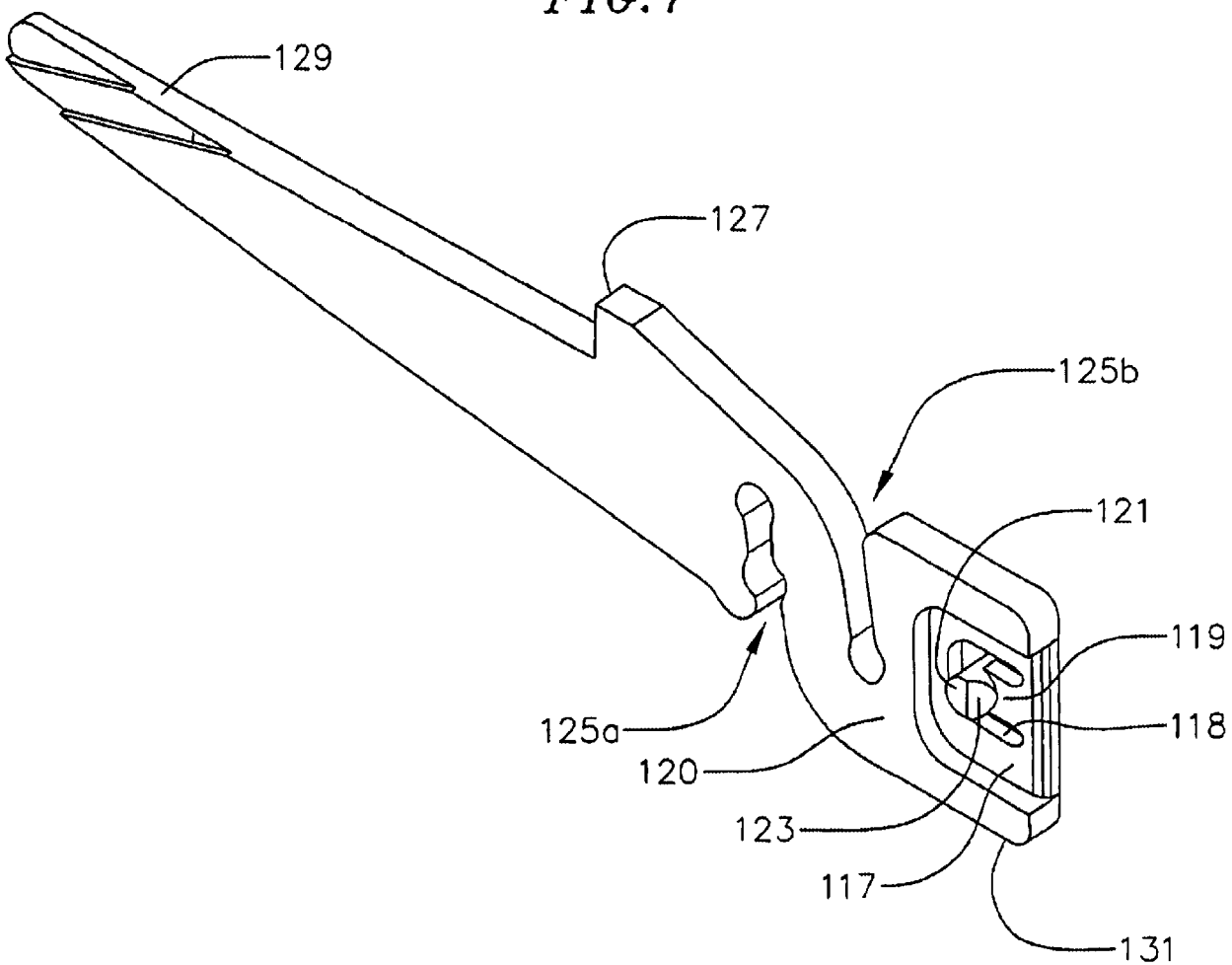
FIG. 7 discloses an alternate embodiment of a latch arm in accordance with the present invention.

FIG. 7 illustrates a further embodiment of a latch arm in accordance with the present invention. The latch arm includes a recess 117. The recess is located in a body 120 of the latch arm. The recess extends to an edge of the body. An aperture 118 located in the recess is formed through the latch arm. A leaf spring 119, formed integrally with the latch arm, extends into the aperture. A post 121 is located at a free end of the leaf spring. The post is mounted such that it protrudes into the recess. The post includes a beveled edge 123 on an end of the post not attached to the leaf spring. In the embodiment illustrated, the beveled edge of the post faces the side of the recess that extends to the edge of the body. The embodiment of FIG. 7 includes notches 125*a,b*, a latch arm stop 127, a latch arm lever 129, and a flat surface 131, arranged as discussed above with respect to FIG. 6.

Figure 8:
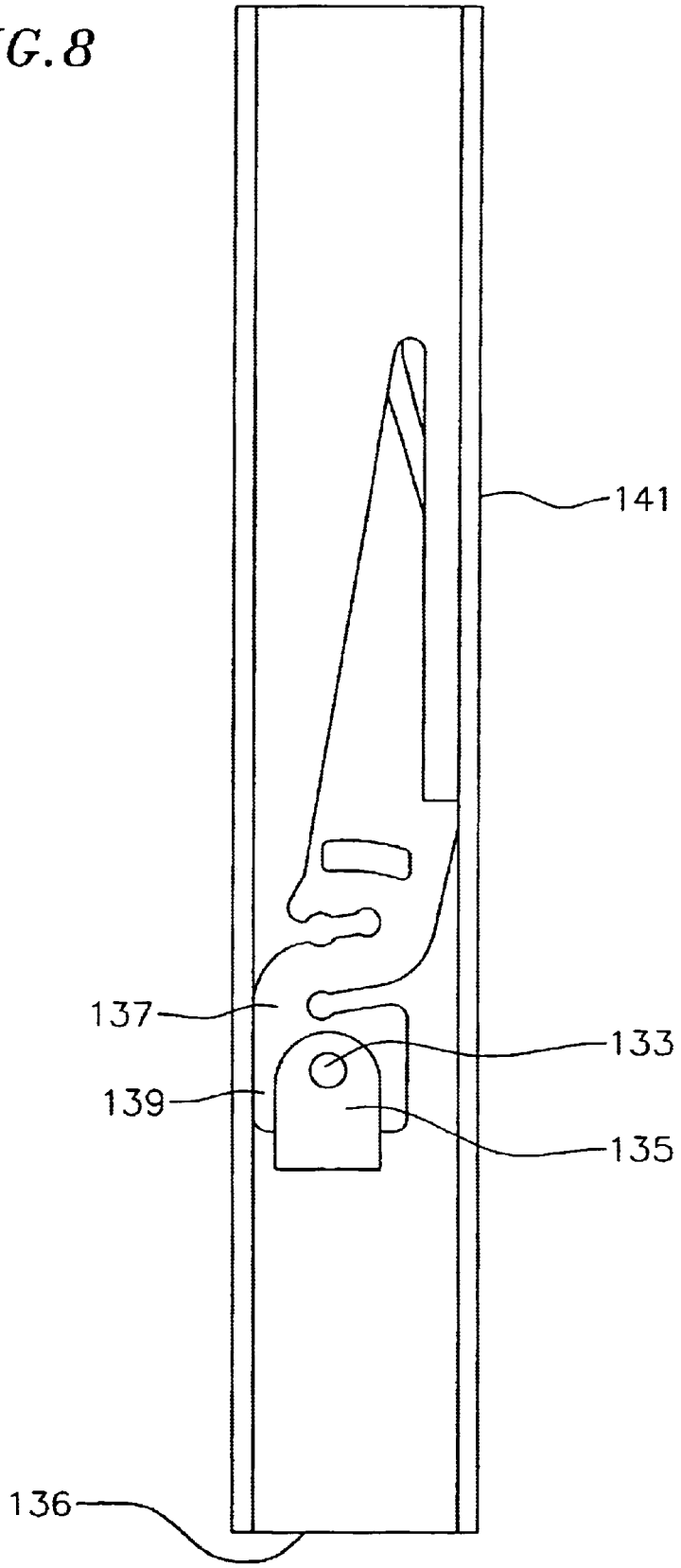
FIG. 8 illustrates the latch arm of FIG. 7 mounted in a slide member.

FIG. 8 illustrates the latch arm of FIG. 7 mounted in an inner member 136 of a slide assembly. When mounted, a post 133 of the latch arm is engaged by an aperture in a bayonet 135 of the inner member. As the aperture is very nearly the same size as the post, the latch arm is held securely to the inner member. A surface 137 of the body is located close to, or in contact with, a first inner member flange 139. As the latch arm is depressed, contact between the inner member flange and the surface reduces the torsional forces acting on the bayonet, recess, and post. In a normal position, the latch arm is biased toward a second inner member flange 141.

Figure 9:
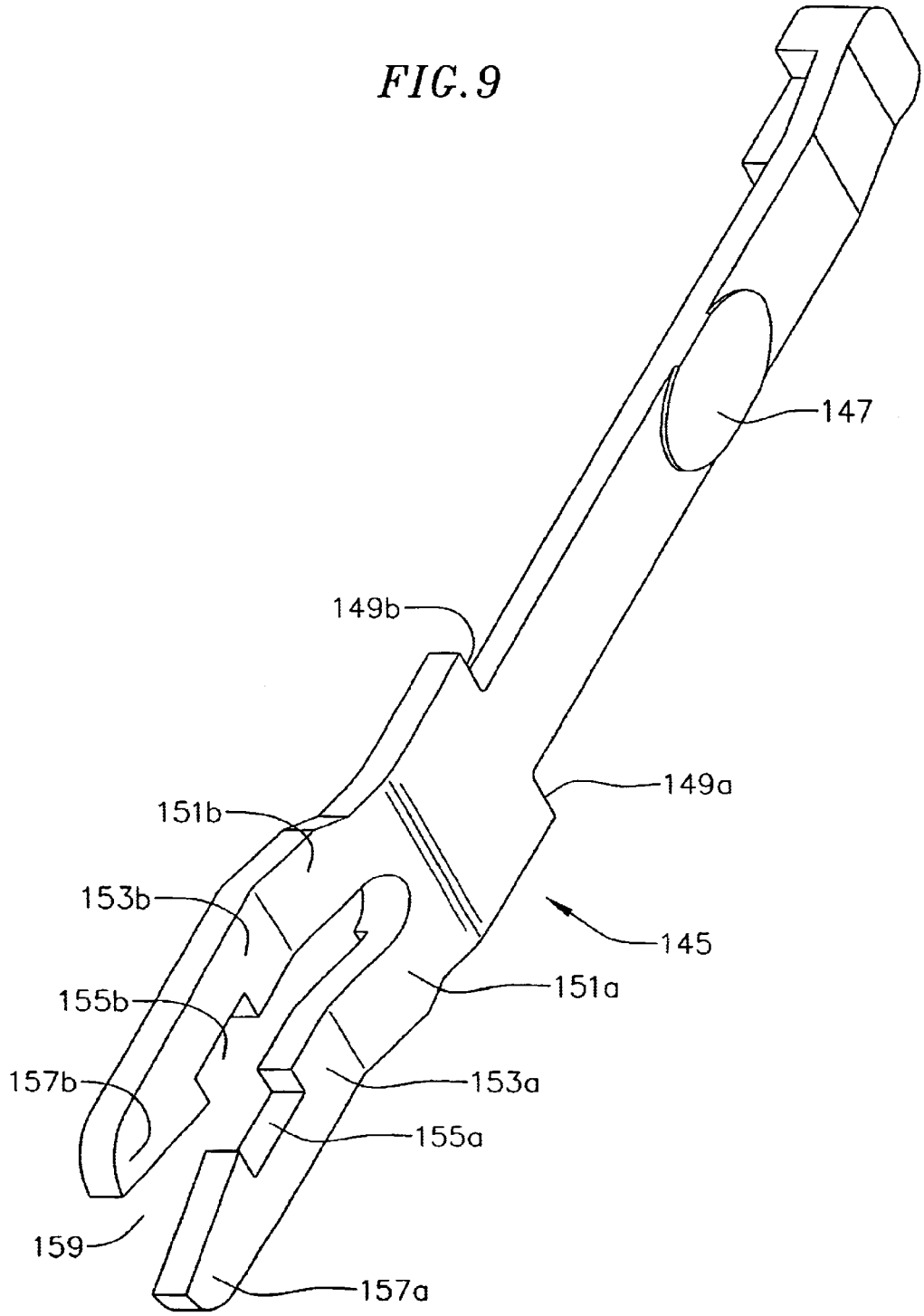
FIG. 9 illustrates a further embodiment of a latch arm in accordance with the present invention.

FIG. 9 is an illustration of another embodiment of a latch arm. The latch arm of FIG. 9 includes a flexible body 145. A latch arm lever 147, is attached to and extends away from the flexible body. The latch arm lever is narrower than the flexible body of the latch arm. The center line of the latch arm lever is approximately aligned with the center line of the flexible body. That is, the flexible body extends beyond the width of the latch arm lever on either side of the latch arm lever. The change in width between the flexible body and the latch arm lever is abrupt, resulting in sheer surfaces that form latch stop surfaces 149*a,b*.

The latch arm of FIG. 9 also includes sloping surfaces 151*a,b* extending from the flexible body on a side of the flexible body opposite the latch arm lever. The sloping surfaces extend slightly downward for a short distance from the flexible body. Tines 153*a,b*, extending away from the flexible body, are integrally formed with the sloping surfaces. The tines are substantially parallel to the latch arm lever and flexible body when they are in a normal position. The tines include notches 155*a,b* located on facing edges of the tines. The tines also contain tapered sections 157*a,b* approximate the ends of the tines. The tapered sections define a trapezoidal space 159 located between the tapered sections and on the side of the notches farthest from the flexible body.

Figure 10:
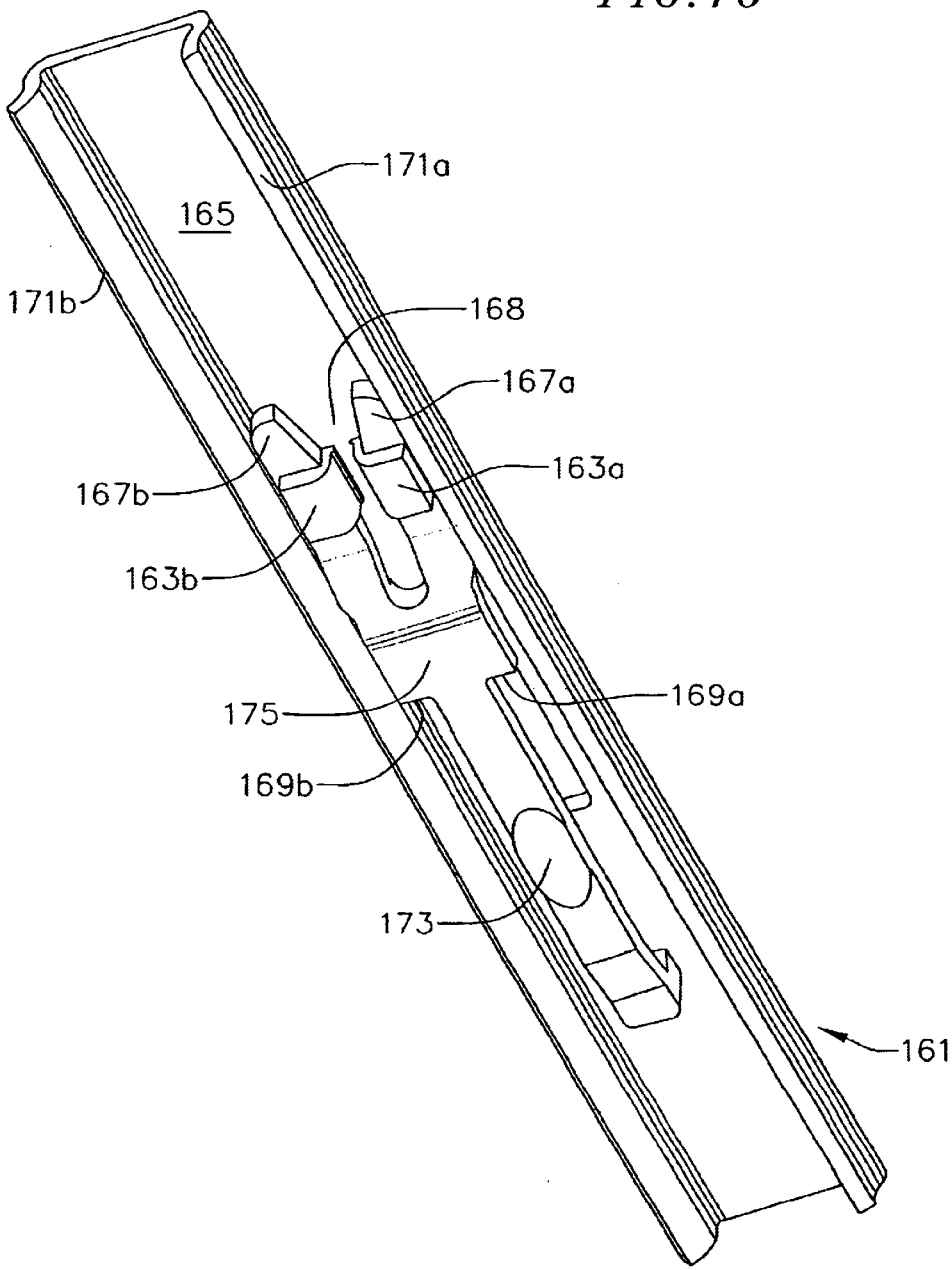
FIG. 10 is a perspective view of the latch arm of FIG. 9 mounted in a slide member.

FIG. 10 illustrates the latch arm of FIG. 9 mounted in a slide member 161. Brackets 163*a,b* engage notches in tines of the latch arm in order to hold the latch arm in place. In one embodiment, the brackets are formed integrally from an inner member web 165, with the brackets lanced out from the inner member web and facing away from each other. During installation, tapered sections 167*a,b* of the latch arm are biased apart as the brackets pass through a trapezoidal space 168 of the latch arm. When the notches engage the brackets, tines of the latch arm grip the brackets and maintain the position of the latch arm, with each bracket preventing motion of the latch arm in forward and reverse directions as well as one lateral direction. In a normal position, latch arm stops 169*a,b* are biased toward edges of inner member flanges 171*a,b*. To separate a slide assembly, the latch arm lever 173 is biased toward the web of the slide member, with the forward end of the latch arm including a contact pad for maintaining a contact point with the slide member web, as illustrated. Flexible body 175 is also deformed toward the web of the slide member. The latch arm stops, being coupled to the flexible body, move toward the web of the slide member, allowing the slide member to be removed from a slide assembly. In an alternative embodiment, the tines are used as a body of a laterally biasable latch arm, such as that of FIG. 3.

Figure 11:
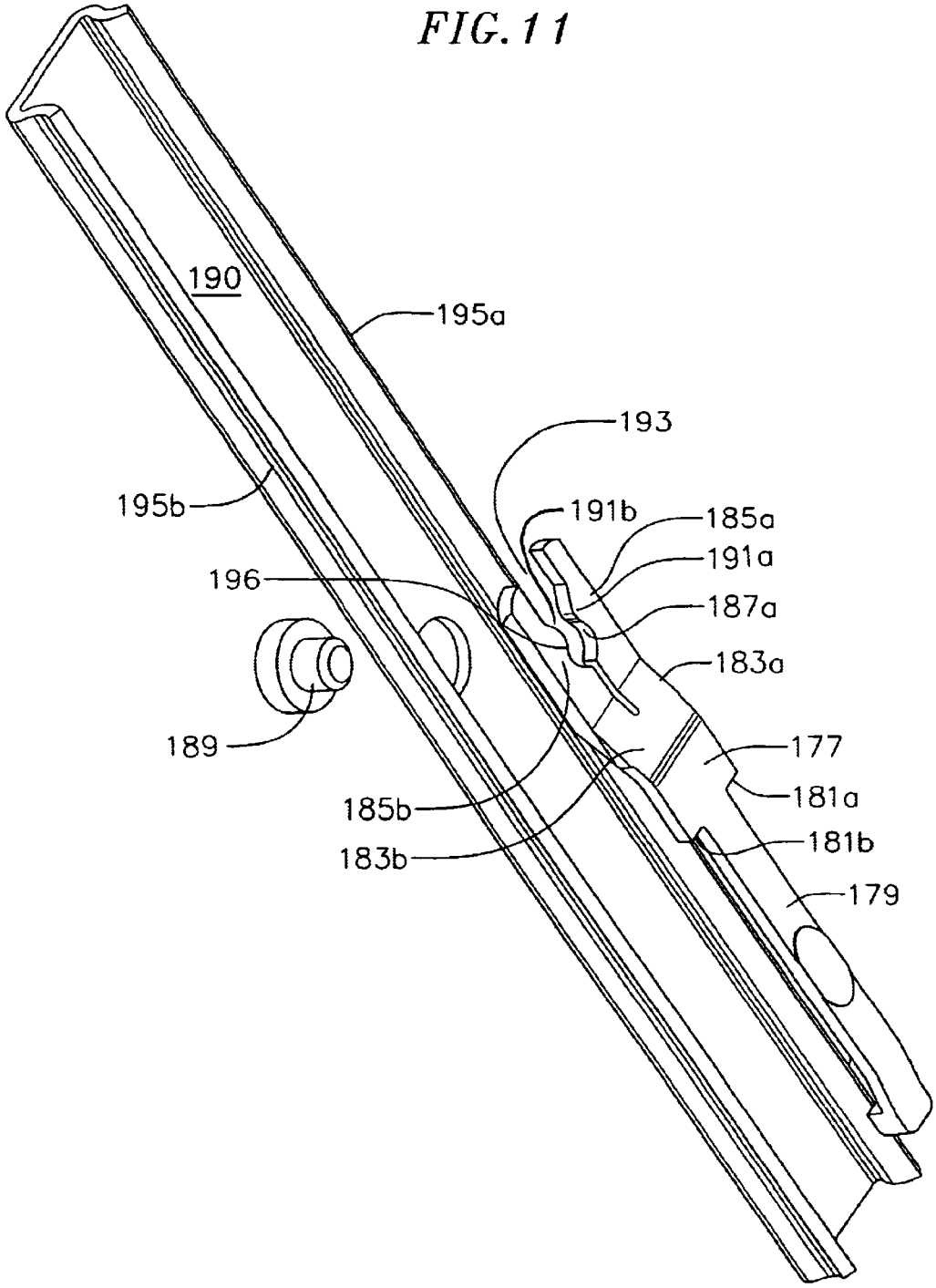
FIG. 11 illustrates a yet another embodiment of a latch arm along with a slide member designed to hold the latch arm.

Another embodiment of a latch arm is illustrated in FIG. 11. The latch arm of FIG. 11 includes a flexible body 177, a latch arm lever 179, latch arm stops 181*a,b*, and sloping surfaces 183*a,b* similar to those discussed above with reference to FIG. 9. In alternative embodiments the portion of the body comprises the notches and window, as well as the finger, of the latch arm of FIG. 3 is used. The latch arm of FIG. 11 also includes tines 185*a,b* protruding from the sloping surfaces in a direction opposite that of the latch arm lever. The tines contain indentations 187*a,b* located on facing edges of the tines. The indentations are shaped so as to grip a pin 189 that protrudes from a web 190 of a slide member. Rises 191*a,b* are located adjacent to the indentations and prevent the latch arm from accidently slipping off of the pin.

During mounting, the pin is placed within a space 193 between ends of the tines. The latch arm is then pressed against the pin, and the pin biases apart the tines. Once the rises pass over the pin, the indentations grip the pin and the tines are biased slightly toward flanges 195 of the slide member. This provides increased lateral stability for the latch arm. The operation of this latch arm is as described with reference to FIG. 10 above.

Figure 12:
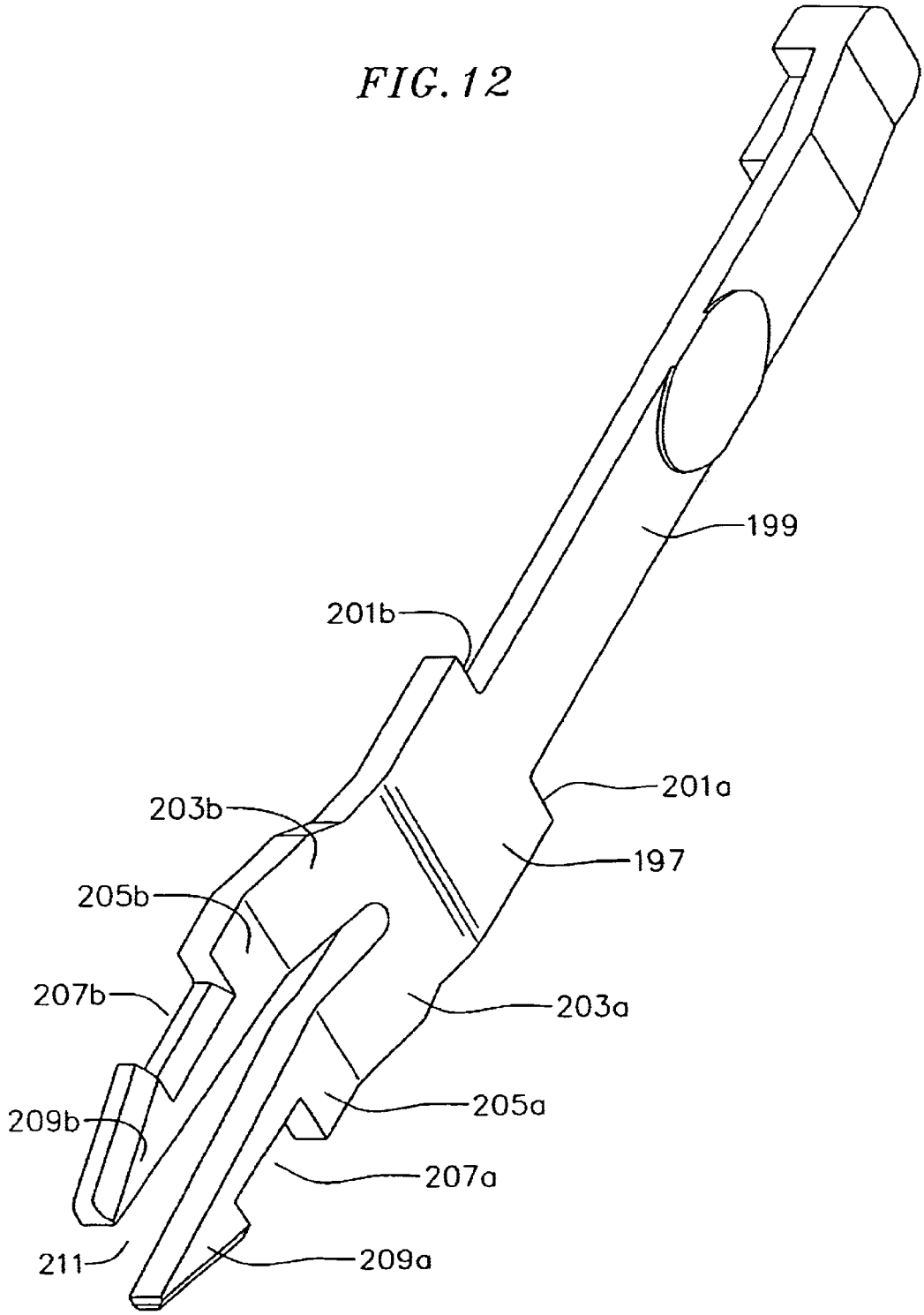
FIG. 12 illustrates a further embodiment of a latch arm in accordance with the present invention.

FIG. 12 illustrates yet another embodiment of a latch arm in accordance with the present invention. The latch arm of the embodiment illustrated in FIG. 12 includes a flexible body 197, a latch arm lever 199, latch arm stops 201*a,b*, and sloping surfaces 203*a,b* similar to those discussed above with reference to FIG. 11, or with respect to the embodiment of FIG. 3. However, tines 205*a,b* of the latch arm of FIG. 12 include notches 207*a,b* on opposing edges of the tines. Spear-shaped ends 209*a,b* of the times define between them a v-shaped area 211.

Figure 13:
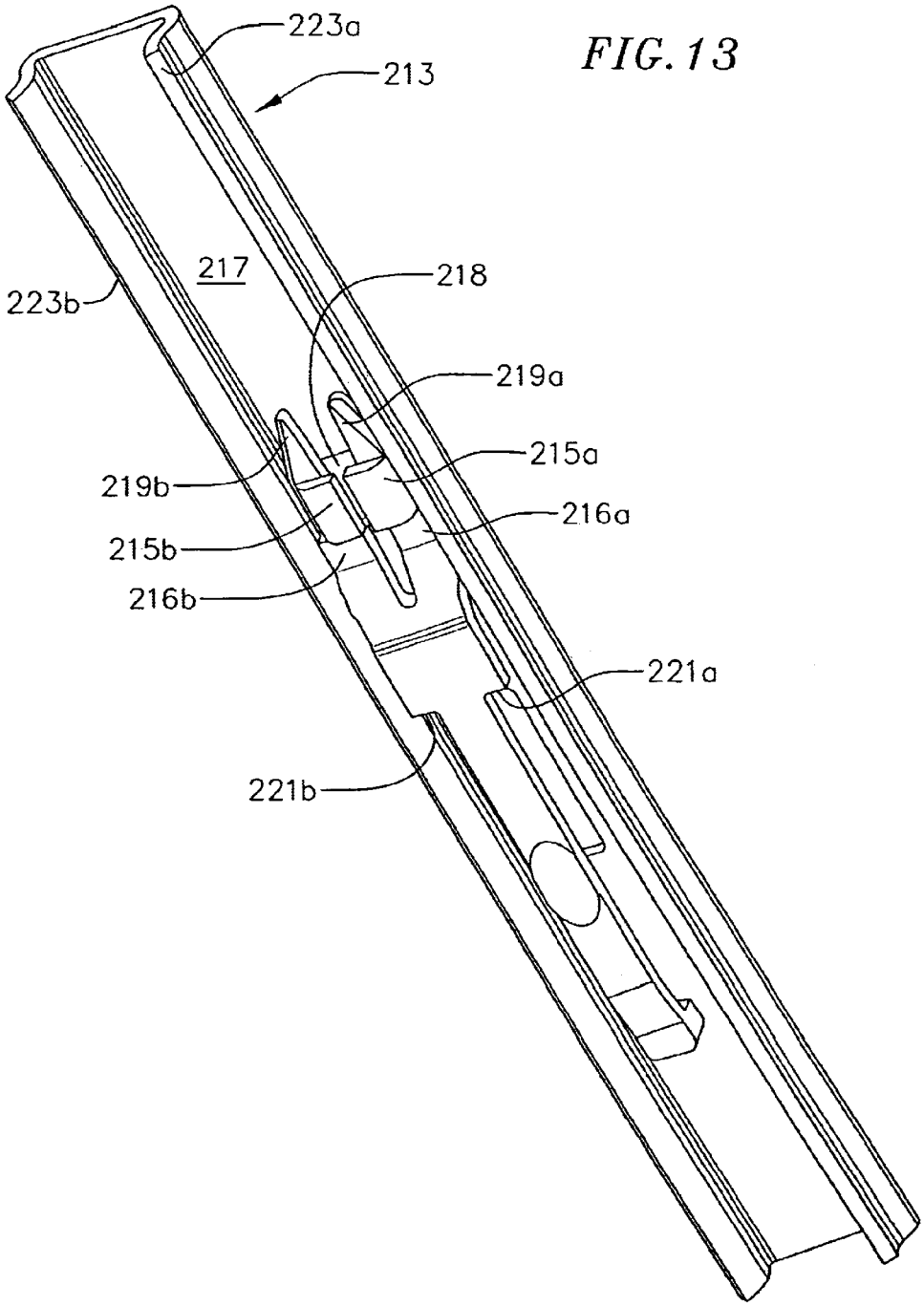
FIG. 13 is a perspective view of the latch arm of FIG. 12 mounted in a slide member.

FIG. 13 illustrates the latch arm of FIG. 12 mounted in a slide member 213. L-brackets 215*a,b* engage notches (beneath the brackets) in tines 216*a,b* of the latch arm in order to hold the latch arm in place. In one embodiment, the brackets are formed integrally from an inner member web 217. The L-brackets of the slide member of FIG. 12 face each other, forming a holding area 218. During installation, spear-shaped ends 219*a,b* of the tines of the latch arm are pressed into the holding area. The brackets bias the tines inward, compressing a v-shaped space between the tines. When the notches engage the brackets, the tines of the latch arm spring back somewhat to grip the brackets and maintain the position of the latch arm. Latch arm stops 221*a,b* are biased toward edges of inner member flanges 223*a,b* in a normal position. The operation of the latch arm is as discussed above with reference to FIG. 10.

Thus, the present invention provides for removable attachment of hardware to drawer slides. Although the invention has been described with respect to certain embodiments, it should be recognized that the present invention includes the claims and their equivalents supported by the disclosure.

What is claimed is:

1. A disconnect latch for a slide assembly comprising at least two slide members, the disconnect latch comprising:

a latch arm laterally biasable along a web of a first slide member;

means for removably fastening the latch arm to the web of (the first slide member of the slide assembly, the means for removably fastening being such that the latch arm is removable from the slide assembly; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member, wherein the means for removably fastening the latch arm to the web of the first slide member comprises a bayonet that protrudes from the web of the first slide member.

2. The disconnect latch of claim 1 wherein the means for preventing disengagement of the slide members comprises a stop on the second slide member in a travel path of a stop surface on the latch arm.

3. A disconnect latch for a slide assembly comprising at least two slide members, the disconnect latch comprising:

a latch arm laterally biasable along a web of a first slide member;

a bayonet protruding from the web of the first slide member and a recess in the latch arm adapted to receive a portion of the bayonet, for removably fastening the latch arm to the web of the first slide member of the slide assembly, being such that the latch arm is removable from the slide assembly; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member.

4. The disconnect latch, of claim 3 further comprising a tab lanced from the web of the first slide member.

5. The disconnect latch of claim 4 wherein the latch arm includes a slot located such that the tab extends into the slot when the recess receives a portion of the bayonet.

6. The disconnect latch of claim 5 wherein the latch arm includes an aperture adapted to receive a fastener.

7. The disconnect latch of claim 3 wherein the means on the second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member comprises a stop on the second slide member in a travel path of a stop surface on the latch arm.

8. A disconnect latch for a slide assembly comprising at least two slide members, the disconnect latch comprising:

a latch arm laterally biasable along a web of a first slide member;

two opposing protrusions from a side of the latch arm, the two opposing protrusions being normally in a first position, with the distance between the protrusions being less than a distance between two bayonets extending from the web of the first slide member, the protrusions being biasable to a second position, with the distance between the protrusions being greater than the distance between the two bayonets; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member.

9. A disconnect latch for a slide assembly comprising at least two slide members, the disconnect latch comprising:

a latch arm laterally biasable along a web of a first slide member;

a bayonet extending from the web of the first slide member, the bayonet containing at least one aperture; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member.

10. The disconnect latch of claim 9 wherein the latch arm includes an integral leaf spring, an end of the leaf spring being coupled to an engagement member, the engagement member adapted to fit in the aperture formed in the bayonet, the leaf spring biasing the engagement member into the aperture.

11. The disconnect latch of claim 10 wherein the engagement member is a post.

12. The disconnect latch of claim 11 wherein post includes a beveled edge.

13. A slide member with a disconnect latch for a slide assembly, the disconnect latch comprising:

a latch arm having a center portion bounded by opposite end portions;

a bayonet extending from a web of the slide member;

a cutout in the latch arm, proximate an end portion of the latch arm, the cutout adapted to receive a portion of the bayonet when the latch arm is placed between the portion of the bayonet and a plane formed by the web of the slide member;

a tab extending from the web of the first member; and an elongated slot in the latch arm, proximate the center portion of the latch arm, adapted to receive the tab, the elongated slot receiving the tab when the cutout receives the portion of the bayonet, wherein one end portion of the latch arm is not attached to the web of the slide member.

14. A slide assembly with disconnect latch hardware comprising:

a slide member having a web and a bayonet extending from the web; and a latch arm between a portion of the bayonet and the web, the latch arm having a post, the post being located in an aperture in a portion of the bayonet.

15. The slide assembly with disconnect latch hardware of claim 14 further comprising a leaf spring formed in the latch arm, with the post extending from the leaf spring, the leaf spring biasing the post into the aperture.

16. A slide assembly with disconnect latch hardware comprising:

a slide member having a web and a bayonet extending from the web; and a latch arm between an extension of the bayonet and the web, the latch arm including two hooked flexible members extending from a side of the latch arm, the area between the flexible members forming a holding area with the bayonet located within the holding area.

17. A slide assembly including a disconnect latch, the slide assembly including the disconnect latch comprising:

a first slide member;

a second slide member slidably coupled to the first slide member, the second slide member having a bayonet extending from a web of the second slide member;

a latch arm with a base portion removably fastened to the bayonet of the second slide member, the latch arm having a lever end extending from a base portion about the bayonet, the lever end being biasable parallel to a plane formed by a web of the second slide member; and a stop on the first slide member, the stop being in the travel path of the latch arm when the latch arm is in an unbiased position.

18. The slide assembly of claim 17 wherein the latch arm contains a recess of substantially the same size and shape as a portion of the bayonet.

19. The slide assembly of claim 18 wherein the latch arm is normally biased towards a flange of the second slide member.

20. The slide assembly of claim 17 wherein the second slide member includes a tab lanced from the web of the second slide member and the latch arm contains a slot, the slot receiving the tab when the latch arm is removably fastened to the bayonet.

21. A slide assembly with removable hardware comprising:

a slide member having a planar web and two brackets extending from the planar web, the brackets having a first portion extending away from the planar web and a second portion extending from the first portion substantially parallel to a plane formed by the planar web, the second portion of each bracket extending in opposing directions, the first portion being separated by a space; and plastic hardware including a body portion having a pair of tines, the tines each having a notch on outer portions of the tines adapted to receive the first portions of the brackets, the tines being flexible so as to allow positioning of the tines in the space between the first portions of the brackets when the tines are flexed towards one another, with the tines each pressing against one of the brackets when the tines are unflexed.

22. The slide assembly with removable hardware of claim 21 wherein the second portions of the brackets prevent motion of the tines in a direction away from the planar web.

23. A slide assembly with removable hardware comprising:

a slide member having a planar web and a pin extending from the planar web; and plastic hardware including a body portion having a pair of laterally flexible tines, the tines each having an opposing notch opposite one another on interior portions of the tines, the notches gripping the pin when the tines are unflexed, the tines being outwardly laterally flexible to allow the pin to be placed between the tines, wherein a latch lever arm extends from the body portion on a side of the body portion opposite the flexible tines and wherein sloping surfaces at the ends of the flexible tines connect the flexible tines to the body portion.

24. A slide assembly with removable hardware comprising:

a slide member having a planar web;

at least two substantially L shaped brackets extending from the planar web, the brackets having a first portion extending in a direction substantially perpendicular to the planar web and having a second portion extending in a direction substantially parallel to the planar web, with the second portions of the brackets extending away from one another; and plastic hardware including a body portion having a pair of laterally flexible tines, the tines each having an opposing notch opposite one another on interior portions of the tines, the notches gripping the brackets when the tines are unflexed, the tines being outwardly laterally flexible to allow the brackets to be placed between the tines.

25. A disconnect latch for a slide assembly comprising at least two slide members, the disconnect latch comprising:

a latch arm laterally biasable along a web of a first slide member;

means for removably fastening the latch arm to the web of the first slide member of the slide assembly, the means for removably fastening being such that the latch arm is removable from the slide assembly; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member, wherein the means for removably fastening comprises a bayonet protruding from the web of the first slide member and a recess in the latch arm adapted to receive a portion of the bayonet.

26. The disconnect latch of claim 25 wherein the means for removable fastening the latch arm to the web of the first slide member includes a tab lanced from the web of the first slide member.

27. The disconnect latch of claim 26 wherein the latch arm includes a slot located such that the tab extends into the slot when the recess receives a portion of the bayonet.

28. The disconnect latch of claim 27 wherein the latch arm includes an aperture adapted to receive a fastener.

29. A disconnect latch for a slide assembly comprising at least two slide members, the disconnect latch comprising:

a latch arm laterally biasable along a web of a first slide member;

means for removably fastening the latch arm to the web of the first slide member of the slide assembly, the means for removably fastening being such that the latch arm is removable from the slide assembly; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member, wherein the means for removably fastening the latch arm to the web of the first slide member includes a bayonet extending from the web of the first slide member and two opposing protrusions from a side of the latch arm, the two opposing protrusions being normally in a first position, with the distance between the protrusions being less than the width of the bayonet, the protrusions being biasable to a second position, with the distance between the protrusions being greater than the width of the bayonet.

30. A disconnect latch for a slide assembly comprising at least two slide members, the disconnect latch comprising:

a latch arm laterally biasable along a web of a first slide member;

means for removably fastening the latch arm to the web of the first slide member of the slide assembly, the means for removably fastening being such that the latch arm is removable from the slide assembly; and means on a second slide member for contacting the latch arm during movement of first slide member relative to the second slide member when the latch arm is in a first unbiased position, and for not contacting the latch arm during movement of the first slide member relative to the second slide member when the latch arm is laterally biased with respect to the web of the first slide member, wherein the means for removably fastening the latch arm to the web of the first slide member includes a bayonet extending from the web of the first slide member, the bayonet containing at least one aperture.

31. The disconnect latch of claim 30 wherein the latch arm includes an integral leaf spring, an end of the leaf spring being coupled to an engagement member, the engagement member adapted to fit in the aperture formed in the bayonet, the leaf spring biasing the engagement member into the aperture.

32. The disconnect latch of claim 31 wherein the engagement member is a post.

33. The disconnect latch of claim 32 wherein post includes a beveled edge.

* * * * *